US006058577A

United States Patent [19]

Ida et al.

[11] Patent Number: 6,058,577

[45] Date of Patent: May 9, 2000

[54] ATTACHMENT STRUCTURE FOR FASTENER MEMBER TO SHEET-LIKE OBJECT

[75] Inventors: Kazuo Ida; Yoshihiro Kanzaka; Hirokazu Watanabe, all of Toyama-ken, Japan

[73] Assignee: YKK Corporation, Tokyo, Japan

[21] Appl. No.: 09/151,589

[22] Filed: Sep. 11, 1998

[30] Foreign Application Priority Data

Sep. 12, 1997 [JP] Japan ..... 9-249151

[51] Int. Cl.[7] ..... A63B 71/14; A41D 19/00

[52] U.S. Cl. ..... 24/306; 24/697.1; 24/697.2

[58] Field of Search ..... 24/306, 442–452, 24/575, 578, 598.4, 598.5, 697.2, 697.1, 698.1, 698.2, 403

[56] References Cited

U.S. PATENT DOCUMENTS

| | | | |
|---|---|---|---|
| 196,429 | 10/1877 | Candlish | 24/697.2 |
| 1,525,694 | 2/1925 | Sage et al. | 24/697.1 X |
| 3,538,914 | 11/1970 | Myers | 24/306 |
| 3,751,770 | 8/1973 | Italiano | 24/697.1 |
| 3,851,357 | 12/1974 | Ribich et al. . | |
| 4,183,121 | 1/1980 | Cousins | 24/575 X |
| 5,007,146 | 4/1991 | Meidan | 24/683 |
| 5,655,268 | 8/1997 | Keyaki et al. | 24/306 X |
| 5,692,276 | 12/1997 | Paxton | 24/697.2 X |
| 5,845,374 | 12/1998 | Briggs | 24/306 X |

*Primary Examiner*—James R. Brittain
*Assistant Examiner*—Robert J. Sandy
*Attorney, Agent, or Firm*—Hill & Simpson

[57] ABSTRACT

In an attachment structure for attaching a fastener member to the wrist of a glove body, a first attachment is to be mounted on and along an open edge of the glove wrist and has a plurality of longitudinally arranged socket holes, and a second attachment is to be mounted on and along an edge of the fastener member and has a locking portion to be removably fitted in the respective socket holes to be engageable with a locking hole of the first attachment. The fastener member can be attached to the glove body by snap action as the locking portion of the second attachment is inserted into the respective socket hole of the first attachment.

18 Claims, 7 Drawing Sheets

ATTACHMENT STRUCTURE FOR FASTENER MEMBER TO SHEET-LIKE OBJECT

BACKGROUND OF THE INVENTION

1. Field of the Invention

The present invention relates to an attachment structure for attaching a fastener member to a sheet-like object, and more particularly to a structure for attaching a surface fastener member to a sheet-like object such as the wrist of a glove for golf player, the closure opening of a garment, or the closure opening of a rucksack.

2. Description of the Related Art

Many of gloves for golf players each have a slit opening in the wrist; in use, after a glove body is worn over the hand, a male or female fastener member attached to the rear side of the wrist fastening band sewn at one end to one of opposite edges of the slit opening is fastened with a companion fastener member attached to the front surface of the glove body near the other slit opening edge, closing the slit opening so as to adjustably tightening the wrist. The fastener members are exemplified by a surface fastener or a snap button. In a bag or the like, a closure is attached to a bag body with one or more fastening bands to close the bag opening.

In the past, when the wrist fastening band is to be attached to the wrist of the glove body or the closure fastening band is to be attached to the bag body, it was the common practice to do so by sewing simultaneously with the sewing of the glove body or the bag body.

The fastening bands of the golf glove generally bear each an emblem or logo mark on its front side. Also in case of bags, particularly in sports bags, the closure band bear on its front side an emblem or logo mark. And the emblems or logo marks to be put on the prospective products are matter-of-factly not limited to the maker's ones but are those of groups or organizations the users belong. In such event, although the main bodies are manufactured as the same semi-products by mass production, only the fastening bands bearing different emblems, logo marks, colors, or designs must be sewn to the main bodies to meet the users' individual orders.

Accordingly, since the fastening bands or closure fastening bands are sewn to the main bodies simultaneously with the sewing of the main bodies, the quantity of both semi-products must coincide. Though the products are manufactured by simultaneous sewing, the common problem in manufacturing golf gloves or bags on the OEM basis was that it takes days more than usual to finish the wrist fastening bands or closure fastening bands. As a result, though the bodies have a general features which can be manufactured by mass production, if the final assembling of the products were started upon completion of the wrist fastening bands or closure fastening bands as semi-products, the delivery of the final products would have become delayed and could hence not have met the deadline.

SUMMARY OF THE INVENTION

It is therefore an object of this invention to provide an attachment structure with which main bodies can be previously manufactured without waiting the completion of wrist fastening bands or closure fastening bands as semi-products and these late manufactured semi-products can be successively attached to the previously manufactured main bodies reliably each in a simple snap action.

The above object is accomplished by a structure for attaching a fastener member to and along an edge of a sheet-like object for engagement of the edge and other part of the sheet-like object, which structure comprising a first or second attachment adapted to be mounted on and along the edge of the sheet-like object; and a second or first attachment adapted to be mounted on and along an edge of the fastener member. In this structure, the first attachment has at least a longitudinally arranged socket hole with which the second attachment engages, and the second attachment has at least a longitudinally arranged locking portion to be removably fitted in the socket holes of the first attachment.

When the fastener member is attached to the sheet-like object, the locking portion of the second attachment is inserted into the socket hole of the first attachment to be engaged.

Preferably, the first attachment is in the form of a rectangular strip of synthetic resin having at least a longitudinally arranged socket projecting from one surface of a base plate of the strip, each of the socket having the socket hole opening toward one longitudinal edge of the rectangular strip, the socket further having in its projecting side end wall a locking hole communicating with the respective one socket hole for locking engagement with a corresponding one of the plugs of the second attachment. And each socket is devoid of opposite side walls.

The second attachment is in the form of a comb-like strip of synthetic resin and has at least a plug which projects perpendicularly to one longitudinal edge of the comb-like strip and terminates each in a vertically projecting locking portion to be removably engaged in the respective one socket hole, the locking portion being a hook.

Alternatively, the first attachment is a rectangular strip of synthetic resin having the socket holes longitudinally arranged at predetermined distances, and the second attachment is in the form of a rectangular strip of synthetic resin having at least a plug being arranged on one surface thereof for being removably engaged one in each of the socket holes.

Further, in case that each of the first and second attachments has a plurality of apertures one between each adjacent pair of the socket holes of the first attachment or between each adjacent pair of the plugs of the second attachment, both of the first and the second attachments have more flexibility so that the second attachment can be attached to and detached from the first attachment.

And the fastener member has on one surface a multiplicity of male or female engaging elements of a surface fastener, or has on one surface a male or female snap-button member. And a companion member has engaging elements of the surface fastener or an engaging element or member which engages with the snap-button member.

The sheet-like object can be exemplified by, besides the golf glove body, a garment or a rucksack body. The fastener member can be exemplified by a fastening band, a closure flap or a closure fastening band, corresponding to the sheet-like object.

DETAILED DESCRIPTION OF THE PREFERRED EMBODIMENTS

Various embodiments of which will now be described in detail with reference to the accompanying drawings.

Figure 1:
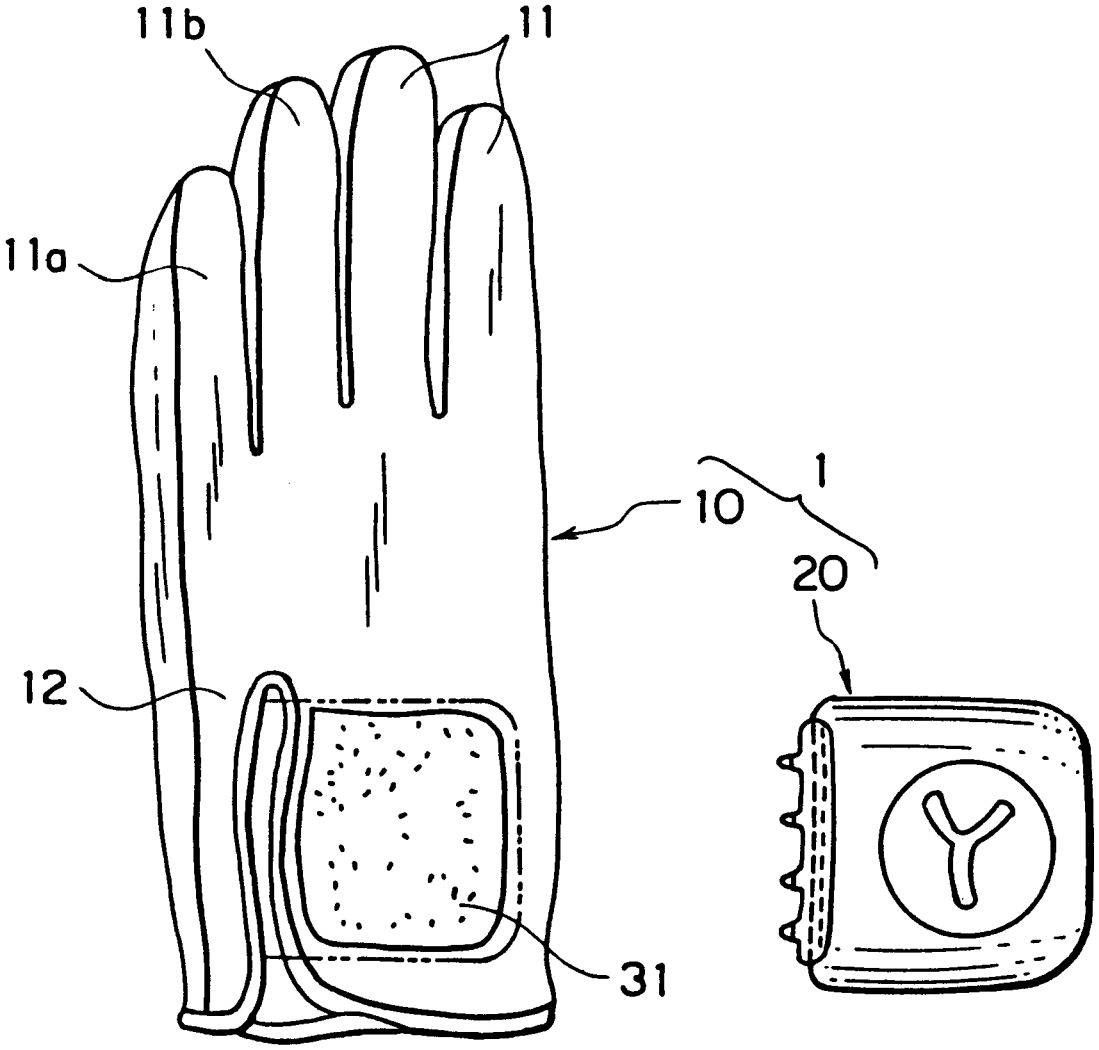
FIG. 1 is an exploded perspective view of a glove for a golf player in which a fastener-member attachment structure according to a first embodiment of the present invention is incorporated.
Figure 2:
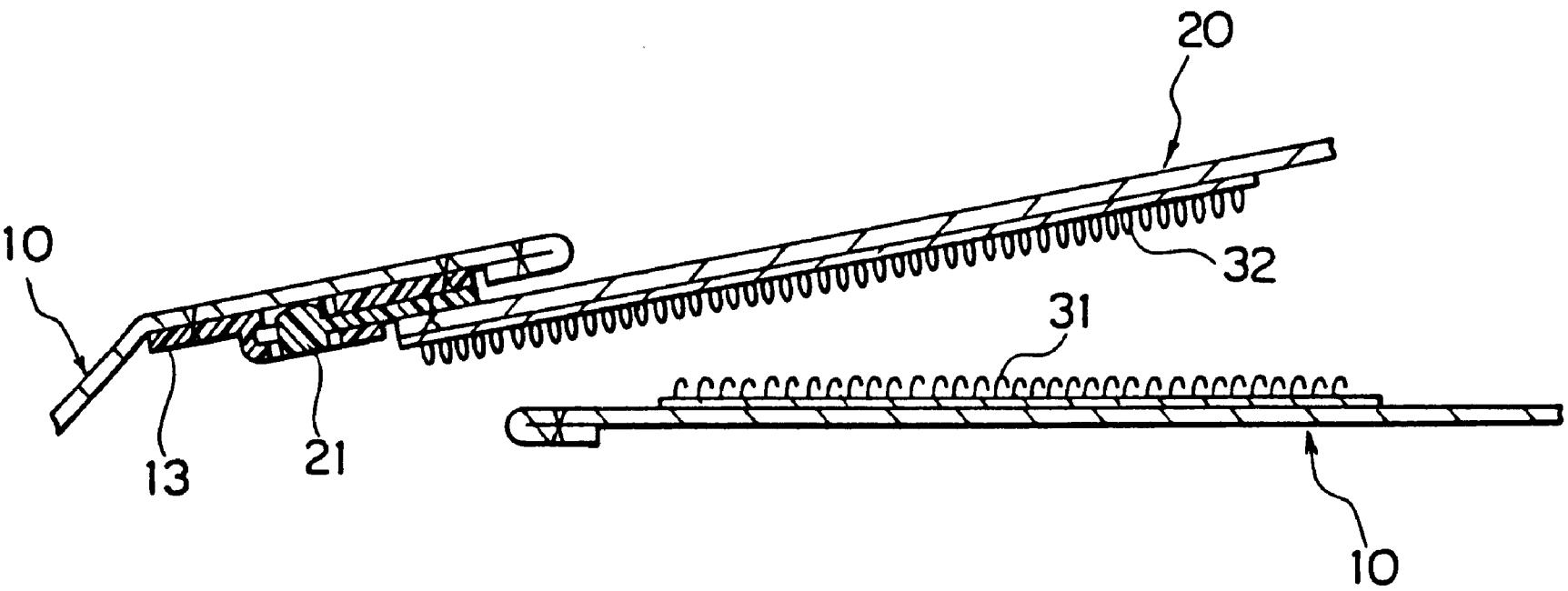
FIG. 2 is a fragmentary cross -sectional view showing the manner in which a fastener member is attached to the glove using the attachment structure.
Figure 3:
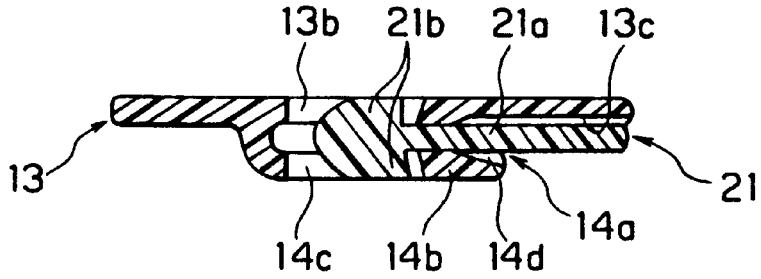
FIG. 3 is an enlarged transverse cross-sectional view of the attachment structure, showing first and second attachments in engagement with each other.
Figure 4:
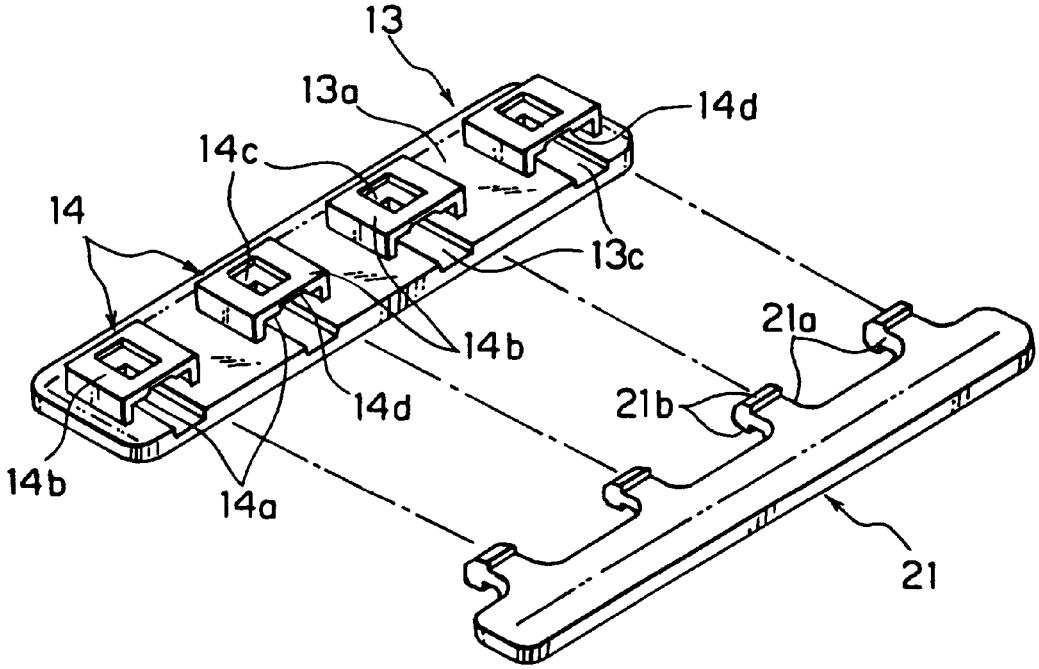
FIG. 4 is an exploded perspective view of the first and second attachments of the attachment structure of the first embodiment.

FIGS. 1 to 4 show a first embodiment in which the attachment structure of the present invention is incorporated in a glove for a golf player; FIG. 1 is a perspective view of the glove, showing a wrist fastening band separated from a body of the glove, FIG. 2 is a cross-sectional view showing the attachment structure in which the wrist fastening band is attached to the glove at an opening thereof, FIG. 3 is a cross-sectional view of the attachment structure, showing first and second attachments coupled together, and FIG. 4 is an exploded perspective view of the first and second attachments of the attachment structure.

A glove 1 for a golf player (hereinafter called the golf glove 1 comprises a glove body 10 and a wrist fastening band 20 attached as being engaged at one end to the glove body 10 as shown in FIGS. 1 and 2. The glove body 10 has a usual glove shape composed of a finger part 11 and a back part 12. The back part 12 has a straight slit extending from an open end edge of the glove body 10 toward and terminating far short of a portion between little- and third-finger portions 11*a*, 11*b*, and the wrist fastening band 20 is attached at one end to an edge of the slit on the side of the little-finger portion 11*a*. The position of this slit should by no means be limited to the illustrated example of FIG. 1 and may be modified alternatively.

For this engagement of the wrist fastening band 20 to the glove body 10, in this embodiment, first and second attachments 13, 21 having specific features of the invention are adapted to be mounted on the little-finger-side edge of the slit and one end edge of the wrist fastening band 20, respectively.

One example of the first and second attachments 13, 21 is shown, on an enlarged scale, in FIGS. 3 and 4. The first and second attachment 13, 21 are molded of thermoplastic synthetic resin, such as polyethylene, polypropylene, polyamide or polyester and are attached to the little-finger-side edge of the glove body 10 and the one end edge of the wrist fastening band 20, respectively, usually by sewing. Alternatively this attaching may be accomplished by ultrasonic welding, thermal welding or by adhering with an adhesive.

As shown in FIG. 4, the first attachment 13 has a base plate 13*a* in the form of a rectangular strip and a plurality of longitudinally arranged sockets 14 projecting from one surface thereof. Each socket 14 is in the form of a right-angled box, bottom wall of which is defined by part of the base plate 13*a* and which has a socket hole 14*a* opening at one direction. Besides, each socket 14 has in its top wall (upper side in FIG. 4) 14*b* as a projecting side end wall confronting the base plate 13*a* a rectangular locking hole 14*c* communicating with the socket hole 14*a*. Further, in this embodiment, the base plate 13*b* has a plurality of locking holes 13*b* each vertically aligned with the locking hole 14*c* in the top wall 14*b* of a respective one of the sockets 14.

Furthermore, as shown in FIG. 3, each socket 14 has in the top wall (lower side in this view) 14*b* and the base plate (upper side in this view) 13 a coacting pair of guide grooves 14*d*, 13*c*, respectively, for guiding a respective one of plugs 21*a* having hooks 21*b* of the second attachment 21, as described below, to the locking holes 14*c*, 13*b*. The guide grooves 14*d*, 13*c* have confronting bottom surfaces converging so as to gradually reduce the respective grooves 14*d*, 13*c* in depth toward the corresponding locking holes 14*c*, 13*c*. When the plug 21*a* of the second attachment 21 is inserted the top wall 14*b* and local part of the base plate 13*a* deform resiliently to facilitate guiding the hooks 21*b*, which are formed on the end of the plug 21*a*, until upper and lower hooks 21*b* are locked in the locking holes 14*c*, 13*b*, respectively.

In the above-described embodiment, the locking holes 14*c*, 13*b* are formed respectively in the top wall 14*b* and the base plate 13*a* and the hooks 21*b* project vertically at the distal end of the plug 21*a* which engage with the two locking holes 14*c*, 13*b* respectively. Alternatively, a modification in which either the top wall 14*b* or the base plate 13*a* has the locking hole and one hook 21*b* is provided at the distal end of the plug 21*a* only on the side corresponding to the locking hole so that they engage at the upper or lower side of the plug 21*a*.

On the other hand, as already described in the previous paragraph with reference to FIG. 4, the second attachment 21 is in the form of a comb-like strip having a plurality of plugs 21*a* projecting perpendicularly to one longitudinal edge and terminating in a vertically projecting hooks 21*b*. Each of these projecting hooks 21*b* constitutes a hook portion of the present invention which are to be removably engaged with the locking holes 14*c*, 13*b* of each of the sockets 14. The pitch of the plugs 21*a* of the second attachment 21 is equal to that of the socket holes 14*a* of the first attachment 13.

For attaching the fastener attachment structure to the glove 1, the first attachment 13 is attached to and along the edge of the side of the little-finger portion 11*a* of the slit of the glove body 10 by sewing the peripheral edge of the base plate 13 with its front edge aligned with and the socket holes 14*a* opening to the confronting open edge of the slit, as shown in FIG. 2. And the second attachment 21 is attached to one end edge of the wrist fastening band 20 by sewing with the plugs 21*a* directed facing toward the first attachment 13.

The thus individually completed glove body 10 and wrist fastening band 20 are combined to complete the golf glove 1 by bringing the second attachment 21 into locking engagement with the first attachment 13 as shown in FIG. 2.

Specifically, the individual plugs 21*a* of the second attachment 21 mounted on the wrist fastening band 20 are inserted into the corresponding socket holes 14*a* of the first attachment 13 mounted on the glove body 10 as shown in FIG. 1, bringing the upper and lower hooks 21*b* of each plug 21*a* into locking engagement with the respective locking holes 14*c*, 13*b* of each socket 14 of the first attachment 13 as shown in FIG. 4.

Using this fastener-member fastening structure, since the glove body 10 and the wrist fastening band 20 separately manufactured can be combined to complete the glove in a simple snap action, it is possible to make the term of delivery than conventional. For example, if the manufacturing of the wrist fastening bands 20 was not finished till close to the end of delivery term, the maker would not have failed to meet the deadline because they can attach the late completed wrist fastening bands 20 to the previously completed glove bodies 10 easily.

In the first embodiment, each socket 14 is the form of a right-angled box with its front wall opening to define the socket hole 14*a* and its bottom wall defined by local part of the base plate 13*a* of the first attachment 13. Alternatively, a rear wall of each socket 14 also may be opened to define another socket hole 14*a* so that two socket holes 14*a*, 14*a* extending through the socket 14. In such alternative form, the top wall 14*b* (upper side in FIG. 4) and the base plate 13*a* have in their confronting inner surfaces a pair of guide grooves 14*d*, 13*c* gradually decreasing in depth from the rear ends toward the center to guide the upper and lower hooks 21*b* of the corresponding plug 21*a* of the second attachment 21 to the locking holes 14*c*, 13*b*. In the presence of these guide grooves 14*d*, 13*c*, the plugs 21*a* of the second attachment 21 can be inserted into the respective socket holes 14*a* of the first attachment 14 from either side so that it will be unnecessary to consider the directivity of the first attachment 13 when it is to be sewn to the glove body 10, thus improving the rate of production.

Figure 5:
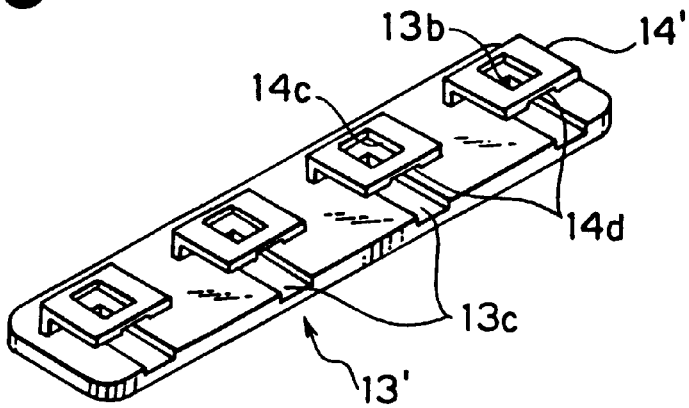
FIG. 5 is a perspective view showing a modification of the first attachment of FIG. 4.

FIG. 5 is a modified first attachment 13' of the first embodiment. This modified first attachment 13' is differentiated over the first attachment 13 of FIG. 4 in that the box-shaped sockets 14 arranged in a longitudinal line on the base plate 13*a* are substituted by a plurality of inverted substantially L-shaped sockets 14' each devoid of the wall where each tooth 21*a* is inserted and a pair of longitudinally opposite side walls thereof. Each modified socket 14', like that of the first embodiment, has a pair of locking holes 14*c*, 13*c* and a pair of guide grooves 14*d*, 13*c*.

Given that the sockets 14' have this structure, if, after the plugs 21*a* of the second attachment 21 have been inserted into the sockets 14' of the first attachment 13 to bring the upper and lower hooks 21*b* into locking engagement with the locking holes 14*c*, 13*b* of the sockets 14', the second attachment 21 happens to become necessary to be removed off the first attachment 13' for some reason, the second attachment 21 can be separated from the first attachment 13' relatively simply as the inverted L-shaped sockets 14' resiliently deforms by pulling the second attachment 21 (the wrist fastening band 20) with a great force. This facilitates bringing the second attachment 21 into locking engagement with the second attachment 13' as compared to the first embodiment.

As another alternative, in consideration of the separation of the first and second attachments 13, 21, there is no need to omit both of the side walls, and one of the longitudinally opposite side walls of each socket 14 may be omitted so that the first and second attachments 13, 21 can be removed off each other much smoothly.

In a further alternative form, either in the top wall 14*b* of each socket 14 or the base plate 13*a* has a locking hole, and a hook 21*b* is formed at the corresponding side of each plug 21*a* with a protuberance provided on the other side of the plug 21*a* so that if the hook 21*b* of the plug 21*a* is pressed downwardly by an external force, the protuberance is pushed against the hole-less top wall 14*b* or base plate 13*a* to widen the socket hole 14*a*, thus releasing the hook 21*b* of the plug 21*a*.

Figure 6:
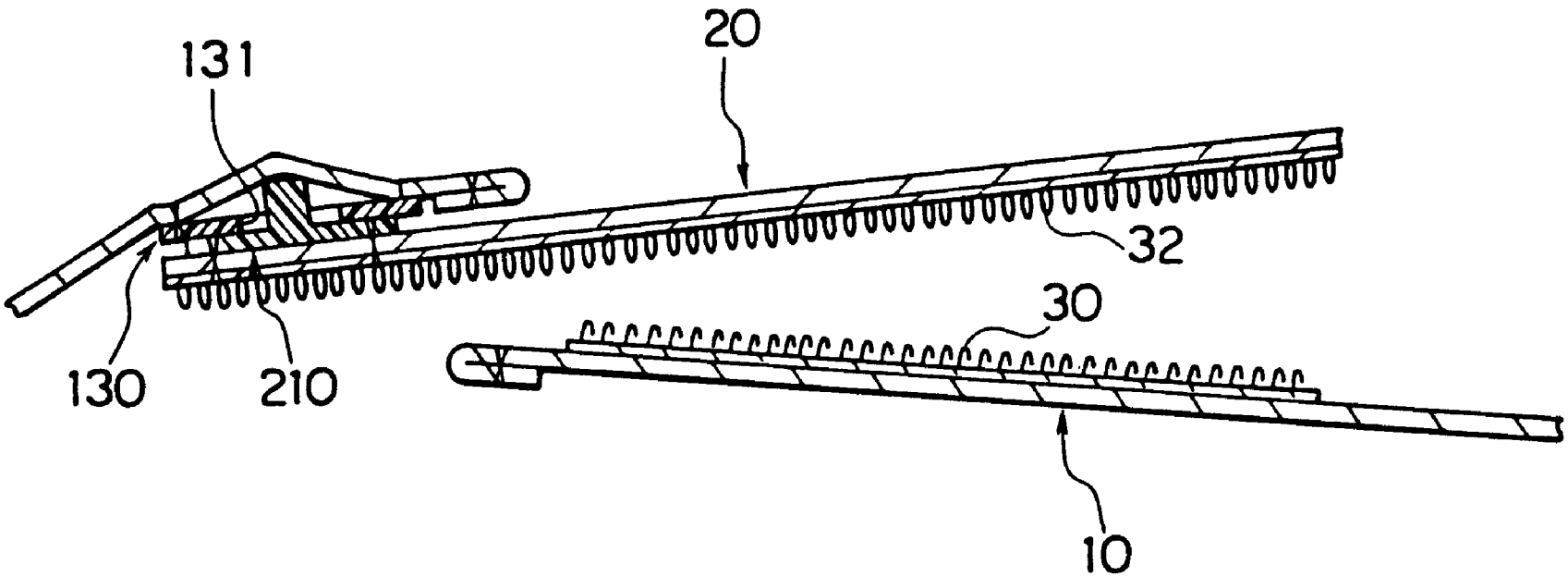
FIG. 6 is a fragmentary cross-sectional view similar to FIG. 2, showing the manner in which the fastener member is attached to the glove using a modified fastener-member attachment structure according to a second embodiment of the invention.
Figure 7:
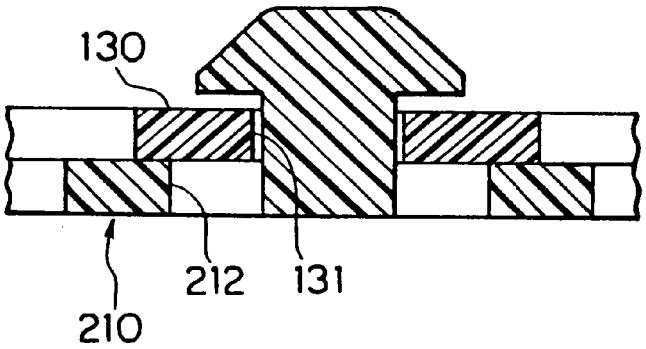
FIG. 7 is a fragmentary longitudinal cross-sectional view of the modified attachment structure, showing first and second members in engagement with each other.
Figure 8:
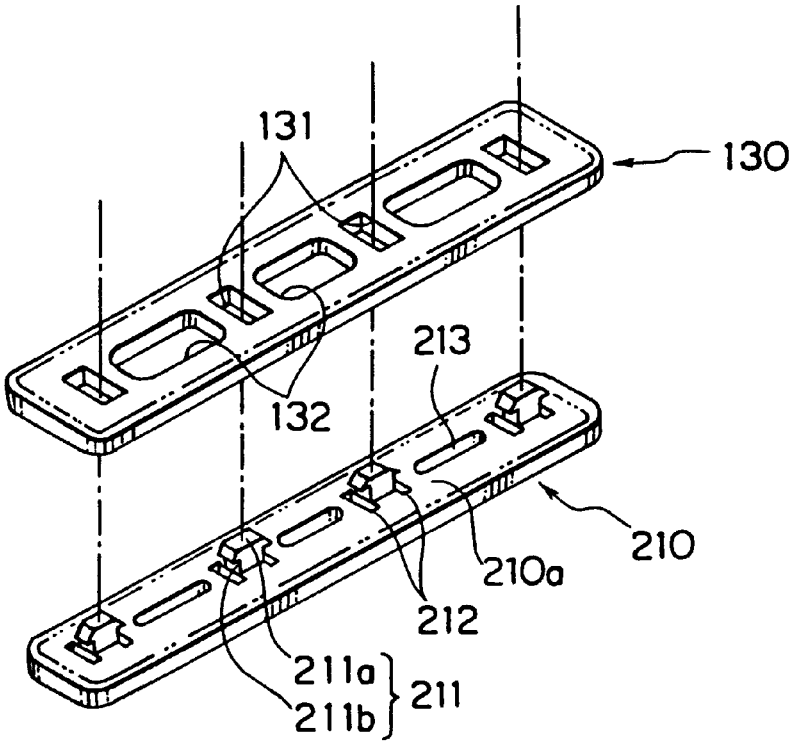
FIG. 8 is an exploded perspective view of the first and second attachments of the modified attachment structure of the second embodiment.

FIGS. 6 through 8 show a second embodiment of the present invention which is differentiated over the first embodiment in that a first attachment 130 is in the form of a rectangular strip molded of the same material as that of the first embodiment and having a plurality of laterally elongated rectangular socket holes 131 longitudinally arranged at a predetermined distances and a plurality of apertures 132 disposed longitudinally of the first attachment 130 and centrally between the socket holes 131. The apertures 132 increases the resilience of the whole first attachment 130.

On the other hand, a second attachment 210 is in the form of a rectangular strip same as the first attachment 130 and has on one surface of a base plate 210*a* at positions corresponding to the socket holes 131 a plurality of longitudinally arranged plugs 211 of T-shape each having a trapezoidal engaging head 211*a* and a stem 211*b* standing thereon, which are to be removably engaged one in each of the socket holes 131. And a plurality of longitudinally elongated apertures 213 are provided one between each adjacent pair of the plugs 211. Besides, a pair of laterally elongated slits 212 is formed adjacent to the foot of each plug 211 at its front and rear positions. The slits 212 and the apertures 213 increase the resilience of the whole second attachment 210.

For attaching the first attachment 130 to the glove body 10, the first attachment 130 is attached along the open edge of the slit at the side of the little-finger portion 11*a* in the back part 12 of the glove body 10 and by sewing along its peripheral edge. And the second attachment 210 is attached to one end edge of the wrist fastening band 20 by sewing along its peripheral edge with the plugs 211 directed upwardly. When the first attachment 130 mounted on the glove body 10 is pressed against the exposed surface (upper side in FIG. 8) of the second attachment 210 attached onto the fastening band 20 by force, the trapezoidal engaging heads 211*a* of the plugs 211 of the second attachment 210 are fitted into the socket holes 131 of the first attachment 130, securing a stable interlocking engagement of the first and second attachment 130, 210 as shown in FIGS. 6 and 7. Thus the wrist fastening band 20 has been attached to the glove body 10 to complete the golf glove 1.

If the glove body 10 and the wrist fastening band 20 happen to become necessary to be separated for a reason, the first and second attachments 130, 210 can be removed off each other relatively simply by pulling them away from each other as the first and second attachments 130, 210 resiliently deform in the presence of the slits 212 and the apertures 132, 213. The other advantageous results are the same as the first embodiment.

Figure 9:
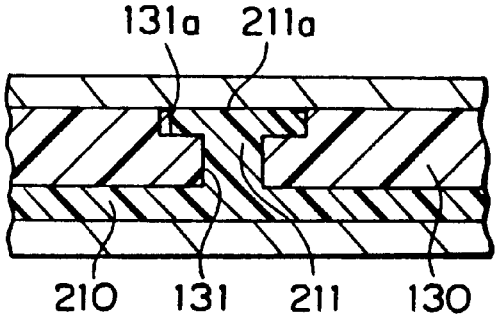
FIG. 9 is a fragmentary transverse cross-sectional view of a modification of the first and second attachments of the attachment structure of FIG. 8.

FIG. 9 shows a modification of the second embodiment in which each plug 211 has a flattened engaging head 211*a* and each socket hole 131 has at its upper end a stepped portion 131*a* fittingly receptive of the flattened head 211*a*. When the second attachment 210 is brought into locking engagement with the first attachment 130, the upper surface of the flattened head 211*a* of the second attachment 210 can be flush with the upper surface of the corresponding socket hole 131, avoiding any local projection of the head 211*a* on the surface of the glove body 10.

Figure 10:
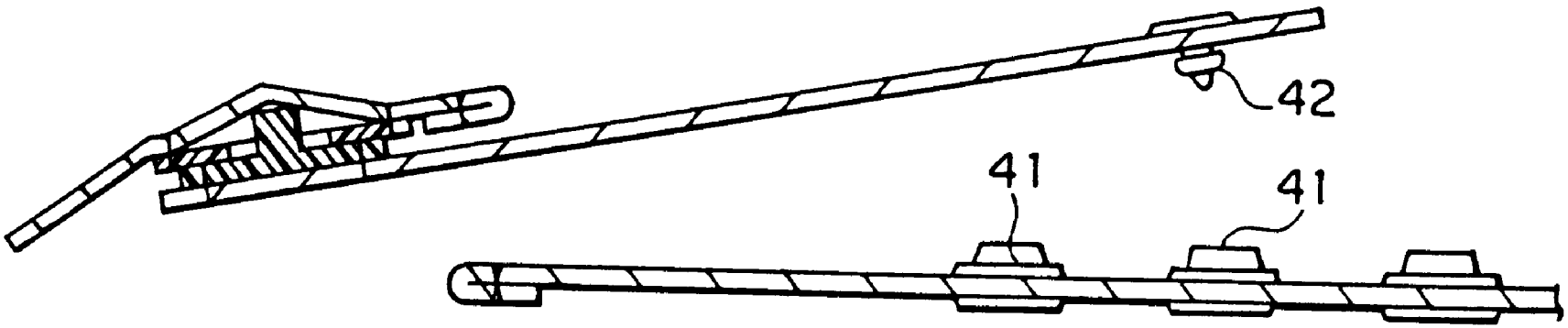
FIG. 10 is a fragmentary cross-sectional view showing the manner of an attachment structure according to a third embodiment of the invention.

In the foregoing embodiments and modifications, a male member 31 of a surface fastener is attached to the outer surface of the glove body 10 and a female member 32 of the surface fastener is attached to the rear surface of the wrist fastening band 20. Alternatively, a number of female members 41 of a snap button may substitute the male surface fastener member 31 of the surface fastener and a male member 42 of the snap button may substitute the female fastener member 32 of the surface fastener, as shown in FIG. 10. Further, in the illustrated examples, the first attachment is mounted on a sheet-like object and the second attachment is mounted on a fastener member but may be the other way round and the same advantageous results can be obtained.

Figure 11:
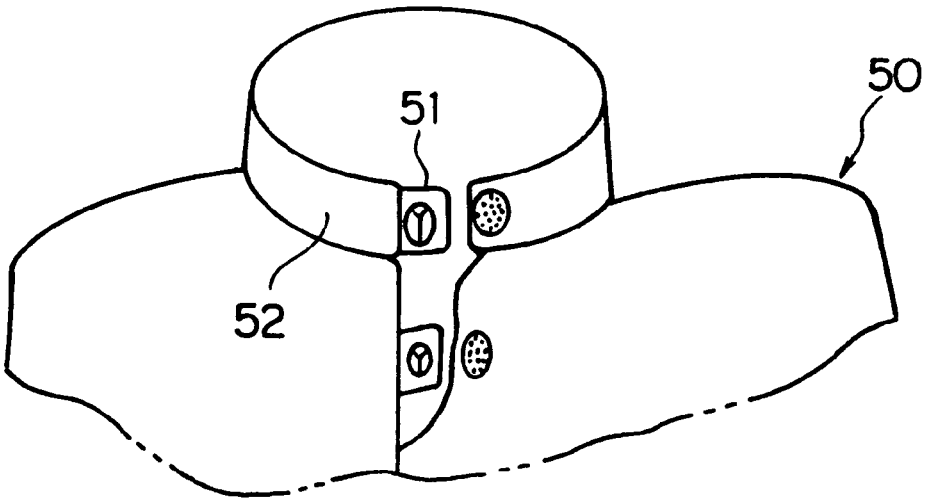
FIG. 11 is a fragmentary perspective view of a garment in which the attachment structure of the present invention is incorporated.
Figure 12:
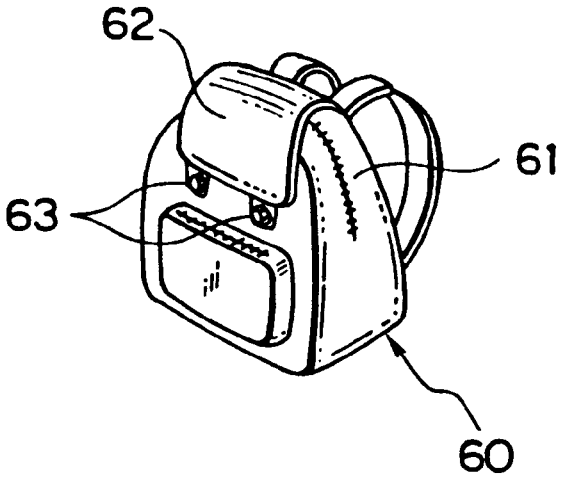
FIG. 12 is a perspective view of a rucksack in which the attachment structure of the present invention is incorporated.

Furthermore, in the foregoing embodiments and modifications, the first and second attachments 13, 21; 130, 210 are used in the golf glove. The present invention should by no means be limited to the golf glove, and for example, it may also be applied to attach a tab 51 to a collar 52 of a garment 50 such as a school uniform or a China dress as shown in FIG. 11. As another alternative, it may be applied to attach tabs 63 to a closure 62 for securing the closure to a sack body 61 in order to close an opening of the sack body 61 of a rucksack 60 as shown in FIG. 12.

As is apparent from the foregoing description, according to the fastener-member attachment structure of the present invention, partly since either one of the interengageable first or second attachment 13, 21; 130, 210 is mounted on a sheet-like object and either one of the second or first attachment 21, 13; 210, 130 is mounted on a fastener member, and the sheet-like object and the fastener member are interengaged together in a simple snap action, and partly since the first and second attachments 13, 21; 130, 210 can be disengaged from each other to separate the fastener member off the sheet-like object in a simple manner, it is possible to previously manufacture a large quantity of the sheet-like objects or fastener members, which are to be used for a wide variety of purposes, and hence to reduce the time of delivery of the final products. Assuming that the sheet-like objects or fastener members are semi-products to be manufactured on the OEM basis, it is possible to avoid any delay of the delivery time of the final products even if the semi-products are delivered with delay, because the final products can be assembled within a considerably short time to safely meet the deadline.

What is claimed is:

1. A structure for attaching a fastener member having an edge to and along an edge of a sheet-like object for engagement of said edge of said sheet-like object to another part of said sheet-like object by said fastener member, said structure comprising:

(a) a first attachment having a longitudinal mounting portion adapted to be mounted on and along one of said edge of the sheet-like object and said edge of the fastener member; and (b) a second attachment having a longitudinal mounting portion adapted to be mounted on and along another one of said edge of the sheet-like object and said edge of the fastener member, wherein said first attachment has at least one longitudinally arranged socket hole with which said second attachment engages and is deformable around said socket hole, and wherein said second attachment has at least one longitudinally arranged enlarged locking portion extending from said second attachment by a narrow portion, the enlarged locking portion being larger than said socket hole and snap-fitted in said socket hole of said first attachment, said longitudinal mounting portions of said first and second attachments being adjacent to each other when said first and second attachments are engaged together.

2. A fastener-member attachment structure according to claim 1, wherein said first attachment is in the form of a rectangular strip of synthetic resin having at least one longitudinally arranged socket projecting from one surface of a base plate of said strip, said socket having said socket hole opening toward one longitudinal edge of said rectangular strip, said socket further having in its projecting side end wall a locking hole communicating with said respective one socket hole for locking engagement with a corresponding plug of said second attachment.

3. A fastener-member attachment structure according to claim 2, wherein said socket is devoid of opposite side walls.

4. A fastener-member attachment structure according to claim 2 or 3, wherein said second attachment is in the form of a comb-like strip of synthetic resin and has at least one plug which projects perpendicularly to one longitudinal edge of said comb-like strip and terminates in a vertically projecting locking portion to be removably engaged in said respective socket hole, said locking portion being a hook.

5. A fastener-member attachment structure according to claim 1, wherein said first attachment is a rectangular strip of synthetic resin having a plurality of said socket holes longitudinally arranged at predetermined distances, and said second attachment is in the form of a rectangular strip of synthetic resin having a plurality of plugs arranged on one surface thereof and each plug removably engaged in one of each of said socket holes.

6. A fastener-member attachment structure according to claim 5, wherein each of said first and second attachments has a plurality of apertures one between each adjacent pair of said socket holes of said first attachment or between each adjacent pair of said plugs of said second attachment.

7. A fastener-member attachment structure according to any one of claims 1 or 5, wherein said fastener member has on one surface a multiplicity of male engaging elements of a surface fastener.

8. A fastener-member attachment structure according to claim 7, wherein said sheet-like object is a glove body of a golf glove, and said fastener member constitutes a wrist fastening band of said glove.

9. A fastener-member attachment structure according to claim 7, wherein said sheet-like object is a closure flap of a garment, and said fastener member constitutes a closure fastening band of said garment.

10. A fastener-member attachment structure according to claim 7, wherein said sheet-like object is a closure flap of a rucksack, and said fastening member constitutes a closure fastening band of said rucksack.

11. A fastener-member attachment structure according to any one of claims 1 or 5, wherein said fastener member has on one surface a male or female snap-button member.

12. A fastener-member attachment structure according to claim 11, wherein said sheet-like object is a glove body of a golf glove, and said fastener member constitutes a wrist fastening band of said glove.

13. A fastener-member attachment structure according to claim 11, wherein said sheet-like object is a closure flap of a garment, and said fastener member constitutes a closure fastening band of said garment.

14. A fastener-member attachment structure according to claim 11, wherein said sheet-like object is a closure flap of a rucksack, and said fastening member constitutes a closure fastening band of said rucksack.

15. A fastener-member attachment structure according to claim 1, wherein said locking portion of said second attachment is removably fitted in said socket hole of said first attachment.

16. A structure for attaching a fastener member having an edge to and along an edge of a sheet-like object for engagement of said edge of said sheet-like object to another part of said sheet-like object by said fastener member, said structure comprising:

(a) a first attachment adapted to be mounted on and along one of said edge of the sheet-like object and said edge of the fastener member; and (b) a second attachment adapted to be mounted on and along another one of said edge of the sheet-like object and said edge of the fastener member, wherein said first attachment has at least one longitudinally arranged socket hole with which said second attachment engages, wherein said second attachment has at least one longitudinally arranged locking portion fitted in said socket hole of said first attachment, and wherein said first attachment is in the form of a rectangular strip of synthetic resin having at least one longitudinally arranged socket projecting from one surface of a base plate of said strip, said socket having said socket hole opening toward one longitudinal edge of said rectangular strip, said socket further having in its projecting side end wall a locking hole communicating with said respective one socket hole for locking engagement with a corresponding plug of said second attachment.

17. A closure structure comprising:

a sheet-like object having first and second parts separated by an opening;

a fastener member having an edge;

a first attachment mounted along an edge of the first part of the sheet-like object;

a second attachment mounted along the edge of the fastener member;

the first attachment having at least one longitudinally arranged socket hole with which the second attachment engages; and the second attachment having at least one longitudinally arranged locking portion fitted in the socket hole of the first attachment.

18. A closure structure according to claim 17, wherein the locking portion of the second attachment has an enlarged locking portion extending from the second attachment by a narrow portion, the enlarged locking portion being larger than the socket hole of the first attachment and snap-fitted in the socket hole.

* * * * *